US007143525B2

(12) United States Patent
Hada et al.

(10) Patent No.: US 7,143,525 B2
(45) Date of Patent: Dec. 5, 2006

(54) THROUGH-AIR DRYER ASSEMBLY

(75) Inventors: Frank S. Hada, Appleton, WI (US); Michael A. Hermans, Neenah, WI (US); Ronald F. Gropp, St. Catharines (CA); Peter K. Costello, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 11/071,744

(22) Filed: Mar. 3, 2005

(65) Prior Publication Data

US 2005/0138832 A1 Jun. 30, 2005

Related U.S. Application Data

(62) Division of application No. 10/748,754, filed on Dec. 30, 2003, now Pat. No. 6,877,246.

(51) Int. Cl.
*F26B 11/01* (2006.01)

(52) U.S. Cl. ..... 34/121

(58) Field of Classification Search ..... 34/119, 34/121, 122, 123, 125, 114; 162/359.1, 358.1; 100/35, 170

See application file for complete search history.

(56) References Cited

U.S. PATENT DOCUMENTS

| | | | | |
|---|---|---|---|---|
| 2,091,805 A | | 8/1937 | Chuse | |
| 2,576,036 A | * | 11/1951 | Ostertag et al. | 165/89 |
| 3,146,160 A | | 8/1964 | Kankaanpaa | |
| 3,273,492 A | | 9/1966 | Justus | |
| 3,432,936 A | | 3/1969 | Cole et al. | |
| 3,590,453 A | | 7/1971 | Bryand | |
| 3,739,491 A | | 6/1973 | Creapo et al. | |
| 3,752,639 A | | 8/1973 | Thagard, Jr. | |
| 3,807,059 A | | 4/1974 | Lopata | |
| 3,819,475 A | | 6/1974 | Lee et al. | |
| 4,036,684 A | | 7/1977 | Schmitt et al. | |
| 4,074,441 A | | 2/1978 | Helversen et al. | |
| 4,124,942 A | | 11/1978 | Ohls et al. | |
| 4,194,947 A | | 3/1980 | Huostila et al. | |
| 4,247,990 A | | 2/1981 | Ohls et al. | |
| 4,481,722 A | | 11/1984 | Guy et al. | |
| 4,606,137 A | | 8/1986 | Whipple | |
| 4,785,759 A | | 11/1988 | Motoyama et al. | |
| 4,793,250 A | * | 12/1988 | Niskanen | 100/35 |
| 4,876,803 A | | 10/1989 | Wedel | |
| 4,905,380 A | | 3/1990 | Eskelinen et al. | |
| 5,020,241 A | | 6/1991 | Fleissner | |
| 5,068,980 A | | 12/1991 | Müller | |

(Continued)

FOREIGN PATENT DOCUMENTS

EP 0315961 A2 5/1989

(Continued)

OTHER PUBLICATIONS

Abstract of WO90/12151 Oct. 18, 1990.

(Continued)

*Primary Examiner*—S. Gravini
(74) *Attorney, Agent, or Firm*—Dority & Manning, P.A.

(57) ABSTRACT

A through-air dryer is disclosed. The through-air dryer includes a cylindrical deck made from a plurality of deck plates that support a throughdrying fabric. The deck plates are supported by opposing hubs. Each of the hubs is in communication with a bearing that is mounted to a stationary shaft for allowing the cylindrical deck and the hubs to rotate. The bearings are positioned so as to create a through-air dryer structure that remains stable during operation and allows for easy calculation of loads on the dryer.

12 Claims, 8 Drawing Sheets

U.S. PATENT DOCUMENTS

| | | | |
|---|---|---|---|
| 5,241,760 | A | 9/1993 | Wedel |
| 5,477,624 | A | 12/1995 | Haessner et al. |
| 5,515,619 | A | 5/1996 | Kahl et al. |
| 5,569,359 | A | 10/1996 | Joiner |
| 5,575,084 | A | 11/1996 | Vuorinen |
| 5,722,180 | A | 3/1998 | Joiner |
| 5,732,319 | A | 3/1998 | Komuro et al. |
| 5,887,358 | A | 3/1999 | Bischel et al. |
| 5,933,979 | A | 8/1999 | Wedel |
| 5,944,959 | A | 8/1999 | Wywialowski |
| 6,032,385 | A | 3/2000 | Bischel et al. |
| 6,083,346 | A | 7/2000 | Hermans et al. |
| 6,093,284 | A | 7/2000 | Hada et al. |
| 6,143,135 | A | 11/2000 | Hada et al. |
| 6,149,767 | A | 11/2000 | Hermans et al. |
| 6,199,296 | B1 | 3/2001 | Jewitt |
| 6,228,220 | B1 | 5/2001 | Hada et al. |
| 6,306,257 | B1 | 10/2001 | Hada et al. |
| 6,331,230 | B1 | 12/2001 | Hermans et al. |
| 6,398,916 | B1 | 6/2002 | Klerelid |
| 6,454,904 | B1 * | 9/2002 | Hermans et al. ..... 162/205 |
| 2002/0092197 | A1 | 7/2002 | Kugler |

FOREIGN PATENT DOCUMENTS

| | | |
|---|---|---|
| EP | 0315961 A3 | 5/1989 |
| EP | 0984097 A2 | 3/2000 |
| EP | 0984097 A3 | 3/2000 |

OTHER PUBLICATIONS

European Search Report for Application No. 04257987.1-2314, dated Feb. 7, 2006.

* cited by examiner

THROUGH-AIR DRYER ASSEMBLY

RELATED APPLICATIONS

The present application is a divisional application of U.S. patent application Ser. No. 10/748,754 filed on Dec. 30, 2003 now U.S. Pat. No. 6,877,246.

BACKGROUND OF THE INVENTION

In the manufacture of high-bulk tissue products, such as facial tissue, bath tissue, paper towels, and the like, it is common to use one or more through-air dryers for partially drying the web or to bring the tissue web to a final dryness or near-final dryness. Generally speaking, through-air dryers typically include a rotating cylinder having an upper deck that supports a drying fabric which, in turn, supports the web being dried. In particular, heated air is passed through the web in order to dry the web. For example, in one embodiment, heated air is provided by a hood above the drying cylinder. Alternatively, heated air is provided to a center area of the drying cylinder and passed through to the hood.

When incorporated into a papermaking system, through-air dryers offer many and various benefits and advantages. For example, through-air dryers are capable of drying tissue webs without compressing the web. Thus, moisture is removed from the webs without the webs losing a substantial amount of bulk or caliber. In fact, through-air dryers, in some applications, may even serve to increase the bulk of the web. Through-air dryers are also known to contribute to various other important properties and characteristics of the webs.

Through-air dryers, however, are typically much more expensive to manufacture and ship in comparison to other drying devices. For instance, many conventional through-air dryers include a rotating cylindrical deck that is made from a single piece construction. In order to permit air flow, the cylindrical deck is porous. Further, in order to support the significant loads that are exerted on the deck during operation, the cylindrical deck has a substantial thickness. In the past, the decks have been made from expensive materials, such as stainless steel, and have been manufactured using expensive procedures. For instance, in order to make the decks porous, the decks are typically configured to have a honeycomb-like structure that requires a substantial amount of labor intensive and critical welding. In order to support the cylindrical deck and to control air flow through the deck, many through-air dryers also include internal baffles and seals that further increase the cost of the equipment.

Further, since the cylindrical deck is a one-piece construction, the shipping costs for through-air dryers are exorbitant. For example, since the decks cannot be disassembled, specially designed shipping arrangements usually are required.

Recently, demands have been made to increase the capacity and efficiency of through-air dryers. As such, gas flow rates through the dryers have increased. In order to shield the bearings that allow the dryers to rotate from the gas flow path, the bearings have been shifted in position. For instance, referring to FIG. 1, a simplified diagram of a prior art through-air dryer is illustrated. As shown, the through-air dryer includes a cylindrical deck 1 that is supported by a pair of opposing heads 2. The heads 2 are mounted on a rotating shaft 3.

The through-air dryer further includes a pair of bearings 4. The bearings 4 allow for the shaft 3 to rotate. In order to prevent the bearings from being exposed to the hot gas flow traveling through the through-air dryer, the bearings are typically spaced a significant distance from the heads 2. Unfortunately, as a result of the placement of the bearings 4, moments represented by the arrows 5 are created when a load 6 is placed on the through-air dryer during operation. The moments need to be supported by the shaft 3, the heads 2, and the cylindrical deck 1. Thus, due to the presence of the moments, even greater deck thicknesses and massive heads are required in designing the through-air dryer, further increasing the cost to manufacture the dryer and the cost to ship the dryer. An added problem with the existing design is that significant stresses are caused by the differential expansion of components during the heating of the through-air dryer and by the differential temperatures of the through-air dryer during steady-state operation. The safest way to start up a traditional through-air dryer is to limit the warm up rate to a few degrees per minute to allow all parts to equilibrate to the same temperature. This subjects the dryer to lowest differential loads, but there are always stresses induced with a rigid design. Another method to limit the effect of differential expansion from temperature is by the use of exotic materials that have different rates of thermal expansion. For example, the deck, which is typically thin and heats up faster that the support structure, can be made from a material that has a lower coefficient of thermal expansion. This net thermal expansion rate between the deck and support structure is more similar reducing stress. While this helps to alleviate the problem, the cost of the through-air dryer is much higher because of the expense of special materials and the special machining and handling necessary to weld them.

As such, a need currently exists for a through-air dryer design that is simple to produce, controls the loads and moment on the structure, is easy to ship and is not practically limited in size. A need also exists for a through-air dryer design that has a lower capital cost and may be disassembled for facilitating construction and shipping of the dryer. A need also exists for a through-air dryer design that does not create high moments that must be supported by the dryer structure.

SUMMARY OF THE INVENTION

In general, the present invention is directed to an apparatus for through-air drying webs. The through-air dryer of the present invention is capable of being disassembled and is therefore easy to ship. The through-air dryer is also capable of accommodating all different sizes, and may, for instance, be built to have large diameters. Further, the through-air dryer is configured so that no significant moments are present in the head or shell from outboard placement of bearings and supports, thereby lessening the structural demands of the device. The use of simple plates to form the deck makes it relatively simple to calculate loads that are exerted on the dryer.

For example, in one embodiment, the apparatus of the present invention includes a cylindrical deck having sufficient open space to permit airflow therethrough. A support structure is positioned to support the cylindrical deck. The apparatus further includes a support shaft concentrically positioned with respect to the cylindrical deck. The support structure is configured to rotate on the support shaft. At least one bearing is positioned between the support shaft and the support structure to permit rotation of the support structure. The bearing is located so that there is substantially no moment transfer between the cylindrical deck and the support structure.

The support structure, for example, may comprise a first hub spaced from a second hub. Each hub engages an opposite end of the cylindrical deck. A first bearing is positioned between the first hub and the support shaft and a second bearing is positioned between the second hub and the support shaft. Each bearing is placed substantially in alignment with each end of the cylindrical deck in order to prevent the creation of moment from the offset of the location of the load relative to the location of support. The alignment of the bearing in the support structure eliminates the moment that the deck is required to carry so that the deck can be designed for fabric load, rotational acceleration and pressure differential alone.

In one particular embodiment, the support structure may include a rotating tube surrounding the support shaft. The rotating tube is connected at a first end to the first hub and at a second end to the second hub. The rotating tube may be used to serve as a shield for the bearings so that the hot gas flow traveling through the dryer does not contact the bearings.

It is recognized that temperature-controlled circulating oil will be required to control the temperature of the bearing during operation. Temperature control is commonly done for circulating oil to control the viscosity of the oil to provide the correct hydrodynamic properties to ensure separation of the metallic elements within the bearing. Bearing cooling is similar to that already done for steam-heated Yankee drying cylinders where steam at elevated temperatures is fed through a shaft which in turn is supported by bearings. Temperature rise from heat transfer of the steam to the shaft and ultimately to the bearing is controlled by oil temperature.

The support structure can further include a first internal deck support and a second internal deck support that extend between the rotating tube and the cylindrical deck. A deck support ring supporting the cylindrical deck in between the first end of the deck and the second end of the deck may be connected to each of the internal deck supports.

The deck itself may comprise a plurality of individual deck plates that are attached to the support structure. For instance, the deck plates may be attached to the support structure using a pin attachment structure that permits thermal expansion. If desired, the deck plates may have a cross sectional profile that tapers in a direction opposite the direction of gas flow through the cylindrical deck. A hot gas, for example, may travel from an exterior surface of the cylindrical deck to an interior space of the dryer. In an alternative embodiment, however, the gas may flow from inside the cylindrical deck to outside the cylindrical deck. In either instance, a hood may surround the cylindrical deck for directing the hot gas stream either into the deck or away from the deck.

For gas flow into the dryer it is advantageous to limit the width of the deck plate as it contacts the web to reduce the tendency to cause sheet marking. It has been found that a contact width of less than 3 mm (⅛ inches) is preferable to prevent sheet marking. This thickness is dependent on the thickness of the fabric. For example, thicker more three dimensional fabrics allow flow in the machine direction so marking would be less noticeable. The location of internal supports is also ideally located away from direct contact with the fabric to facilitate air flow.

In order to dry a web, the web may be carried on a throughdrying fabric that is wrapped around the cylindrical deck. The throughdrying fabric may be wrapped around the cylindrical deck from an upstream point to a downstream point leaving an open free end. In this embodiment, the apparatus may further include an external baffle positioned over the open free end of the cylindrical deck for shielding the open free end from external air.

In accordance with the present invention, the cylindrical deck and the support structure may be made from multiple parts that may be easily assembled. For instance, as described above, the cylindrical deck is made from a plurality of plates. In addition, the support structure may include opposing hubs that also may be comprised of multiple parts. In this manner, when the apparatus is being shipped, the shipping volume of the apparatus may have a greatest dimension of no greater than one half the diameter of the cylindrical deck.

Other features and aspects of the present invention are discussed in greater detail below.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

Figure 1:
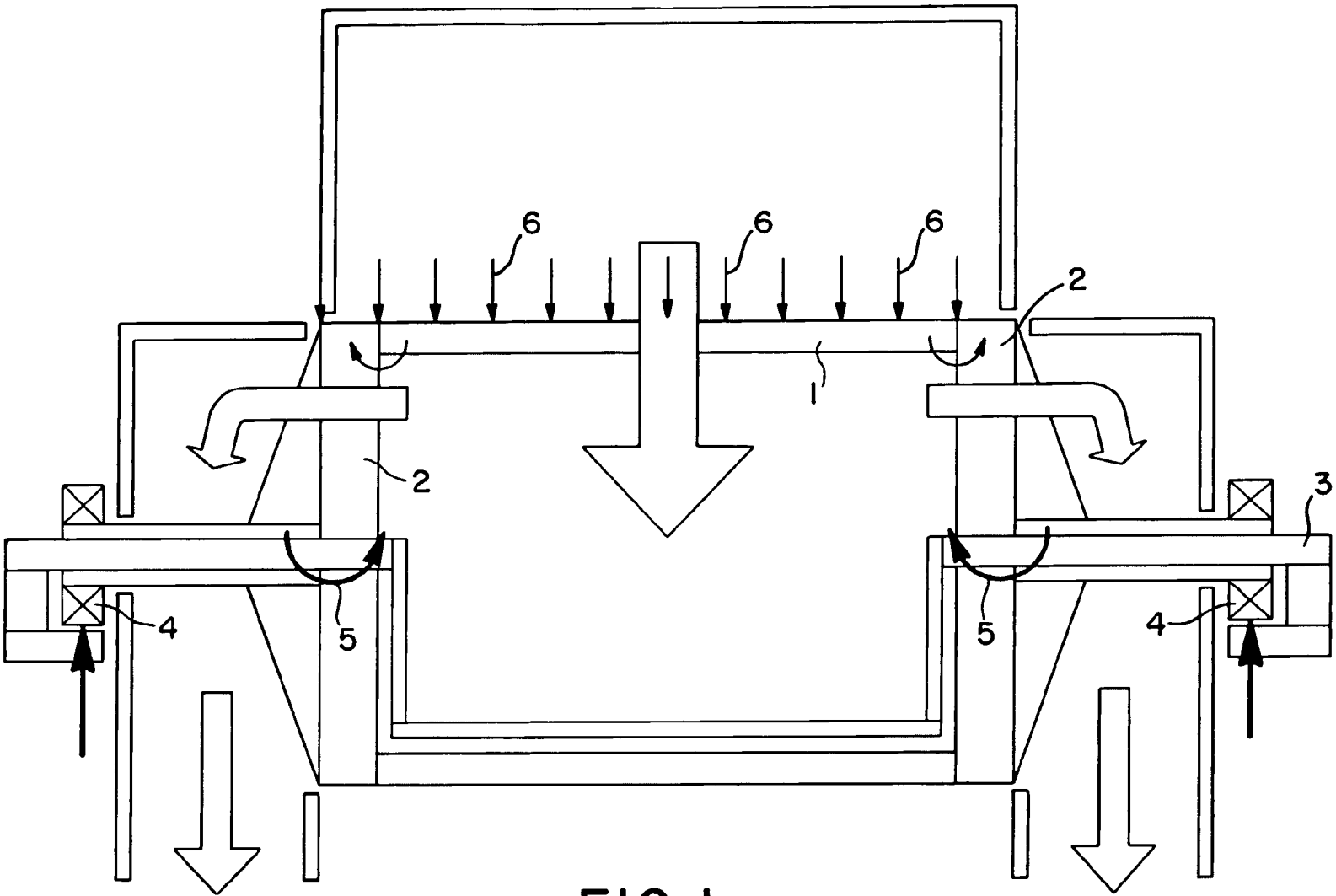
FIG. 1 PRIOR ART
FIG. 1 is a cross sectional view of a through-air dryer showing conventional placement of bearings that cause the creation of moments in the structure.

Repeated use of reference characters in the present specification and drawings is intended to represent the same or analogous features or elements of the invention.

DETAILED DESCRIPTION OF THE INVENTION

It is to be understood by one of ordinary skill in the art that the present discussion is a description of exemplary embodiments only, and is not intended as limiting the broader aspects of the present invention.

In general, the present invention is directed to a through-air drying apparatus, which passes a heated gas through a web in order to dry the web. The through-air drying apparatus has multiple and numerous applications. For example, in one embodiment, the apparatus may be used for drying a tissue web. It is also recognized that the same principles of design can be used for smaller rolls typically used for vacuum or pressure transfer of the web between sections of a paper machine.

The through-air dryer of the present invention, in one embodiment, is made from multiple components that may be easily assembled and/or disassembled. In this manner, not only is the through-air dryer relatively inexpensive to manufacture, but also may be shipped without any significant difficulties or added expense.

Of particular advantage, due to the ability to vary the size of the dryer, due to the close spacing of the bearing centers, and due to lower capital costs, the through-air dryer of the present invention is well suited to being incorporated into existing tissue making lines that do not currently include a through-air dryer. For instance, the through-air dryer of the present invention is well suited to replacing a Yankee dryer or other similar drum drying device for improving the properties of tissue webs produced on the line. Machines that currently have a Yankee dryer are generally limited in available room outside the machine frames and machine frames are relatively narrow. The short distance between bearing centers makes a dryer of this design particularly advantageous for this application.

In one embodiment of the present invention, the through-air dryer is made in a manner such that no significant moment transfers occur between major components of the structure of the dryer. For instance, the bearings that support rotation of the dryer may be substantially aligned with each end of a rotating drying cylinder. In this manner, loads applied to the dryer are supported in a more stable manner preventing moment between sections.

Although the through-air dryer may be used in multiple and numerous applications, as described above, in one embodiment, the through-air dryer is particularly well suited for use in the manufacture of tissue webs. It is also recognized that the same principles of design can be used for smaller rolls typically used for vacuum or pressure transfer of the web between sections of a paper machine.

Figure 2:
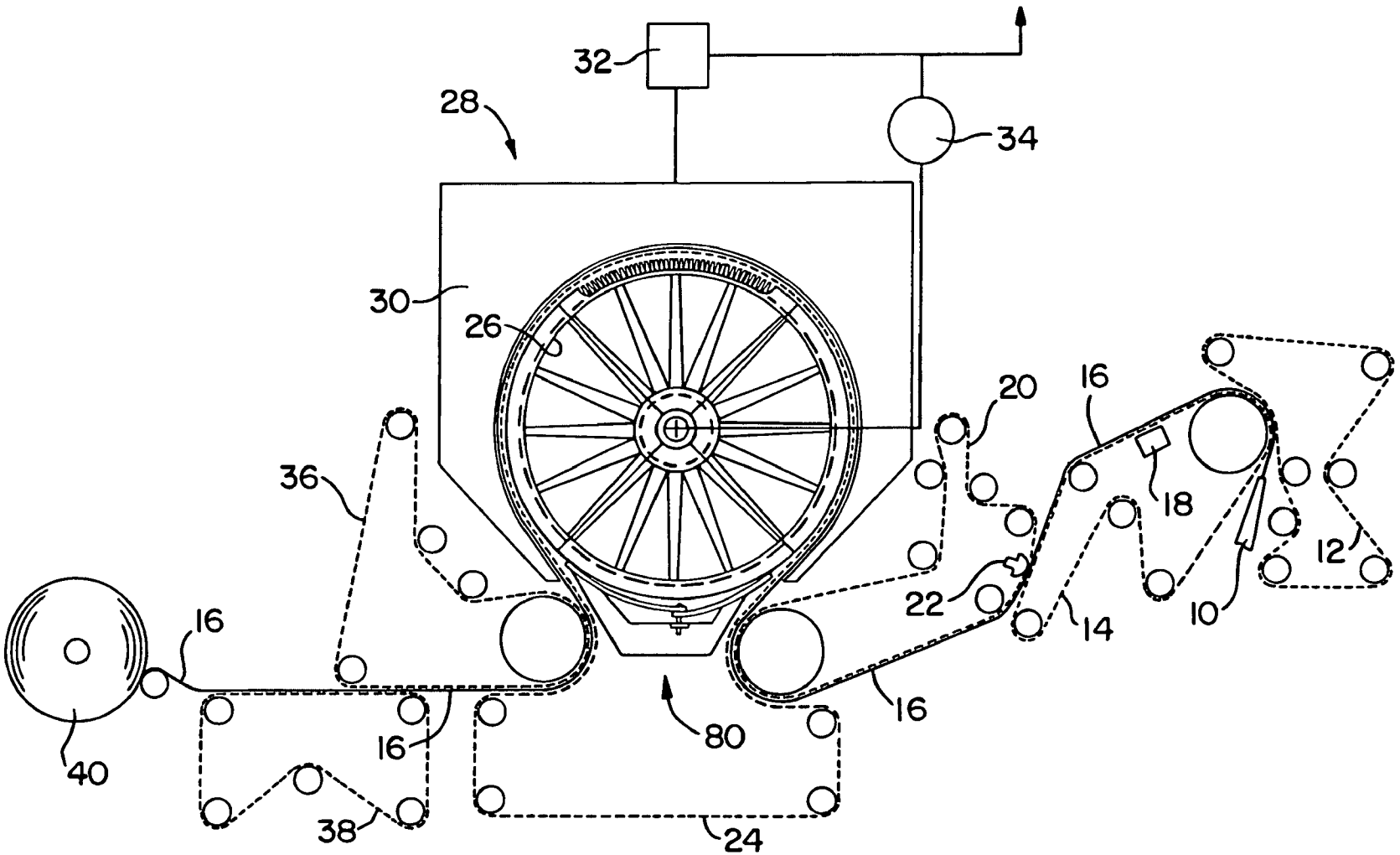
FIG. 2 is a side view of one embodiment of a tissue making process incorporating a through-air dryer made in accordance with the present invention.

For purposes of illustration, for instance, one embodiment of a papermaking process made in accordance with the present invention is shown in FIG. 2. As illustrated, the system includes a head box 10 which injects and deposits a stream of an aqueous suspension of papermaking fibers between a first forming fabric 12 and a second forming fabric 14. The forming fabric 14 serves to support the newly-formed wet web 16 downstream in the process as the web is partially dewatered to a consistency of about 10 dry weight percent. Additional dewatering of the wet web 16 can be carried out, such as by vacuum suction, using one or more vacuum boxes 18. As shown, the vacuum box 18 is positioned below the forming fabric 14. The vacuum box 18 applies a suction force to the wet web thereby removing moisture from the web.

From the forming fabric 14, the wet web 16 is transferred to a transfer fabric 20. The transfer may be carried out using any suitable mechanism. As shown in FIG. 2, in this embodiment, the transfer of the web from the forming fabric 14 to the transfer fabric 20 is done with the assistance of a vacuum shoe 22.

In one embodiment, the web 16 may be transferred from the forming fabric 14 to the transfer fabric 20 while the transfer fabric 20 is traveling at a slower speed than the forming fabric 14. For example, the transfer fabric may be moving at a speed that is at least 5%, at least 8%, or at least 10% slower than the speed of the forming fabric. This process is known as "rush transfer" and may be used in order to impart increased machine direction stretch into the web 16.

From the transfer fabric 20, the tissue web 16 is transferred to a throughdrying fabric 24 and carried around a cylindrical deck 26 of a through-air dryer generally 28 made in accordance with the present invention. As shown, the through-air dryer 28 includes a hood 30. A hot gas, such as air, used to dry the tissue web 16 is created by a burner 32. More particularly, a fan 34 forces hot air created by the burner 32 into the hood 30. Hood 30 directs the hot air through the tissue web 16 carried on the throughdrying fabric 24. The hot air is drawn through the web and through the cylindrical deck 26.

At least a portion of the hot air is re-circulated back to the burner 32 using the fan 34. In one embodiment, in order to avoid the build-up of moisture in the system, a portion of the spent heated air is vented, while a proportionate amount of fresh make-up air is fed to the burner 32.

In the embodiment shown in FIG. 2, heated air travels from the hood 30 through the drying cylinder 26. It should be understood, however, that in other embodiments, the heated air may be fed through the drying cylinder 26 and then forced into the hood 30.

While supported by the throughdrying fabric 24, the tissue web 16 is dried to a final consistency of, for instance, about 94% or greater by the through-air dryer 28. The tissue web 16 is then transferred to a second transfer fabric 36. From the second transfer fabric 36, the dried tissue web 16 may be further supported by an optional carrier fabric 38 and transported to a reel 40. Once wound into a roll, the tissue web 16 may then be sent to a converting process for being calendered, embossed, cut and/or packaged as desired.

In the system and process shown in FIG. 2, only a single through-air dryer 28 is shown. It should be understood, however, that the system may include a plurality of through-air dryers if desired. For example, in one embodiment, a pair of through-air dryers may be arranged in series. One through-air dryer may be for partially drying the web while the second through-air dryer may be for completing the drying process.

Referring to FIGS. 3–6, more detailed views of the through-air dryer 28 are shown. As shown particularly in FIGS. 3 and 5, the through-air dryer 28 includes, in this embodiment, a stationary support shaft 50 that is concentrically positioned with respect to the cylindrical deck 26. The shaft 50 extends from a first side of the through-air dryer 28 to a second and opposite side. The deck 26 is intended to rotate about the shaft 50. In this regard, a support structure exists in between the shaft 50 and the cylindrical deck 26.

Figure 5:
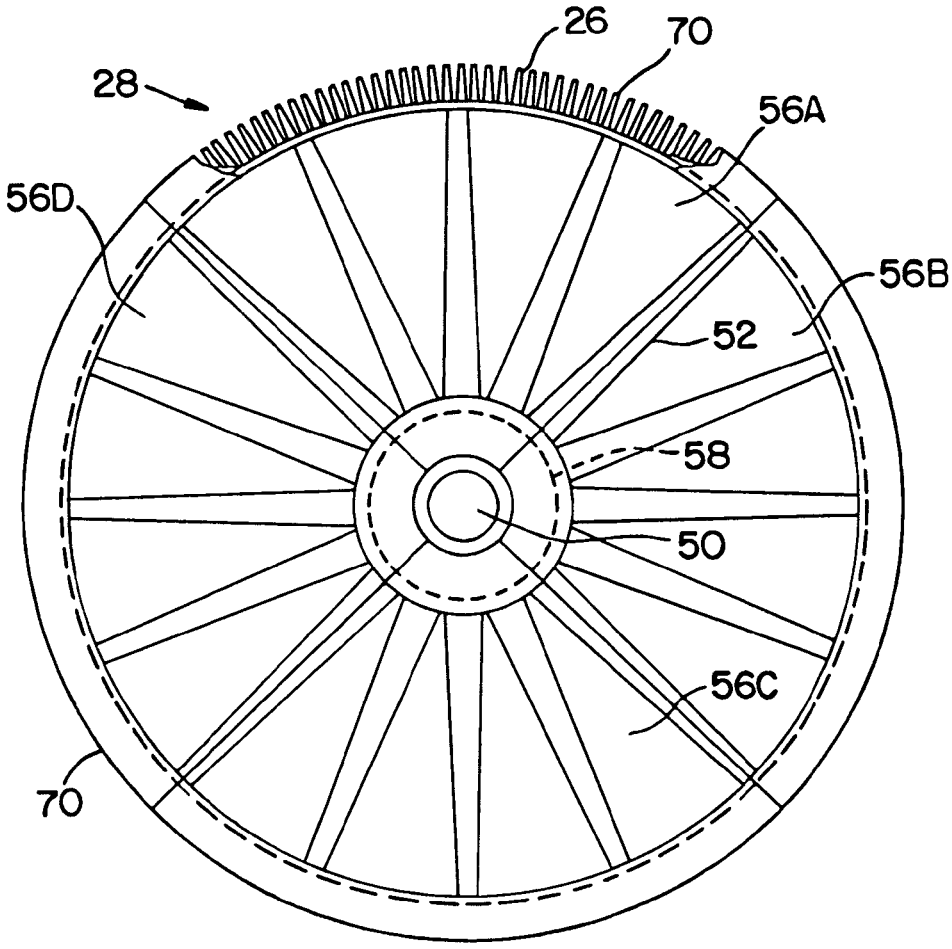
FIG. 5 is a side view of the through-air dryer shown in FIG. 3.

The support structure includes a first hub 52 and a second hub 54. The hubs 52 and 54 support each end of the cylindrical deck 26. As shown in FIG. 5, the hub 52 may be made from multiple pieces or components 56A, 56B, 56C, and 56D. Each of the components 56A, 56B, 56C and 56D are connected together and also are connected to the cylindrical deck. Further, the hub 52 includes passages for permitting air flow through the hub. For example, as shown in FIG. 5, the hub 52 can generally be considered to have a spoked arrangement.

Referring back to FIG. 3, in this embodiment, the through-air dryer 28 further includes various other internal components that assist in supporting the cylindrical deck 26. For instance, the through-air dryer 28 includes a rotating tube 58, a first internal support member 60, a second internal support member 62, and a deck support ring 64, that all rotate with the cylindrical deck. As shown, the internal support members 60 and 62 are attached to the rotating tube 58 on one end and to the deck support ring 64 on an opposite end. In this manner, the deck support ring supports the cylindrical deck 26 at a mid region between each end of the cylindrical deck.

The internal support members 60 and 62 can be in the shape of plates and, as will be described in more detail below, can assist in directing air flow through the dryer. The internal support members 60 and 62 may be of a single piece construction or may be of a multi-piece construction as desired.

Figure 3:
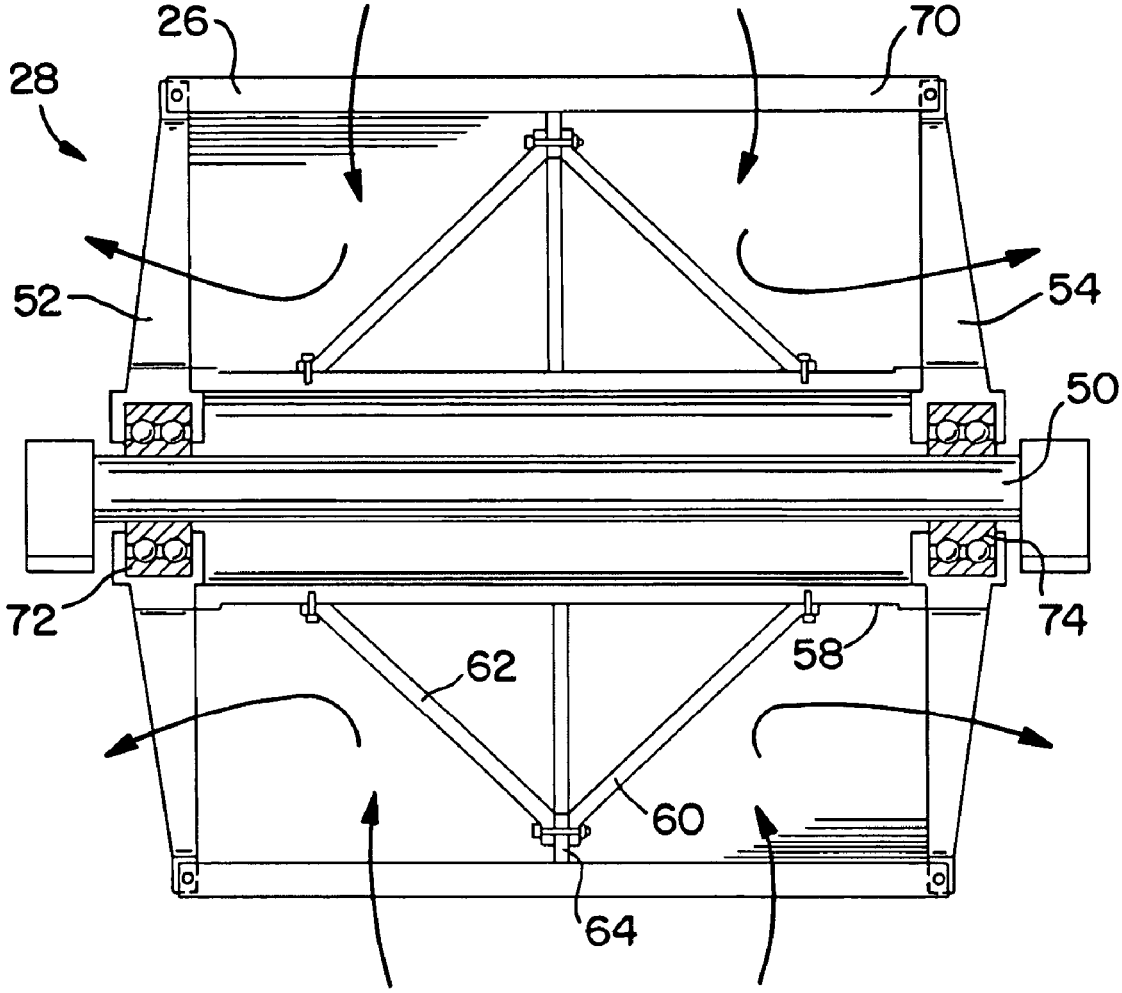
FIG. 3 is a cross sectional view of one embodiment of a through-air drying device in accordance with the present invention.
Figure 3A:
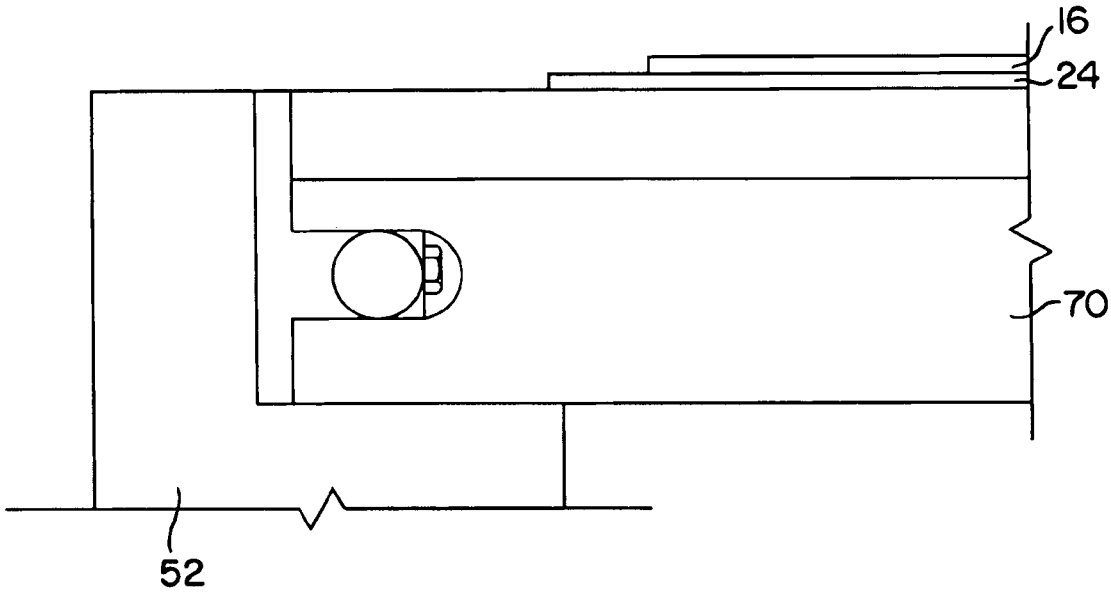
FIG. 3A is a cross sectional view of a single plate connection in accordance with one embodiment of the present invention.
Figure 4:
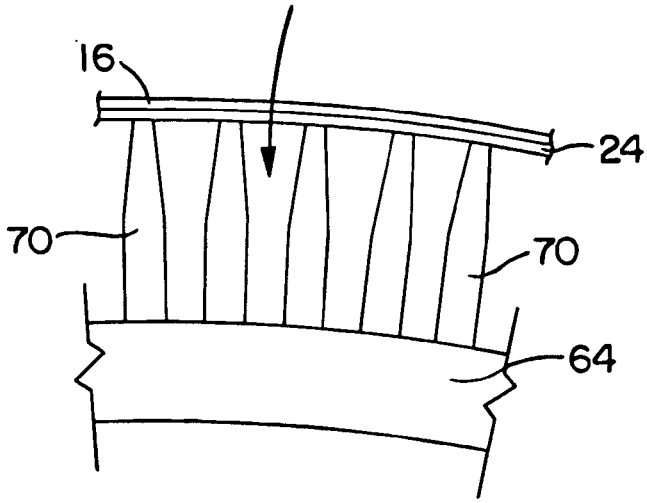
FIG. 4 is a partial side view of the through-air dryer illustrated in FIG. 3.

Referring to FIGS. 3–5, the cylindrical deck 26 is shown in greater detail. As opposed to many conventional through-air dryers in which the cylindrical deck is made from a single piece of welded material, in this embodiment, the cylindrical deck 26 comprises a plurality of individual plates 70. The plates are connected to the hubs 52 and 54 at each end. Specifically, the plates 70 may be connected to the hubs 52 and 54 in a manner that allows for thermal expansion. For example, as shown in FIG. 3, the plates 70 may be connected to the hubs 52 and 54 using a pin connection. For example, as can be seen in the embodiment illustrated in FIG. 3A, each plate 70 may be connected to hub 52 and hub 54 (not shown in FIG. 3A) using a pin connection that allows thermal expansion. For instance, plate 70, carrying through-drying fabric 24 and web 16, may include an indentation to allow thermal expansion while connected to hub 52, as shown. Likewise, the plates 70 may also be connected to the deck support ring 64 in a manner that allows thermal expansion. For instance, in one embodiment, each plate may include an indentation into which the deck support ring 64 is received. In this manner, the plates 70 may move relative to the deck support ring 64 while remaining supported by the deck support ring.

In FIG. 4, the deck plates 70 are shown supporting a throughdrying fabric 24 which is used to carry a web 16 being dried. In the embodiment shown in FIG. 4, hot gases flow through the web 16, through the throughdrying fabric 24, and in between the deck plates 70. The deck plates 70 should be spaced apart a distance sufficient to permit gas flow through the plates while also being spaced a distance sufficient to support the throughdrying fabric 24.

The actual distance that the deck plates 70 are spaced apart depends on various factors, including the size of the through-air dryer 28, the amount of load being placed upon the through-air dryer and the amount of gas flow through the dryer. In general, the deck plates 70 may be spaced from about 12 millimeters (½ inches) to about 254 millimeters (10 inches) apart, such as from about 1 inch to about 6 inches apart. For example, when the cylindrical deck 26 has a diameter of about 5 meters (16.4 feet) the plates 70 may be spaced apart 75 millimeters (2.95 inches).

In order to facilitate air flow through the cylindrical deck 26, as shown in FIG. 4, the deck plates 70 may be tapered. In particular, the deck plates are tapered in a direction opposite gas flow. In this manner, the gas flow is more easily initially passed through the cylindrical deck and then accelerated as the gases pass the deck plates 70.

In order to prevent wear of the throughdrying fabric 24, the deck plates 70 may be coated with a material that reduces the coefficient of friction. For example, in one embodiment, the deck plates may be coated with a polytetrafluoroethylene coating marketed as Teflon® by the Dupont Company or a low wear ceramic coating as manufactured by Praxair Coatings.

Figure 6:
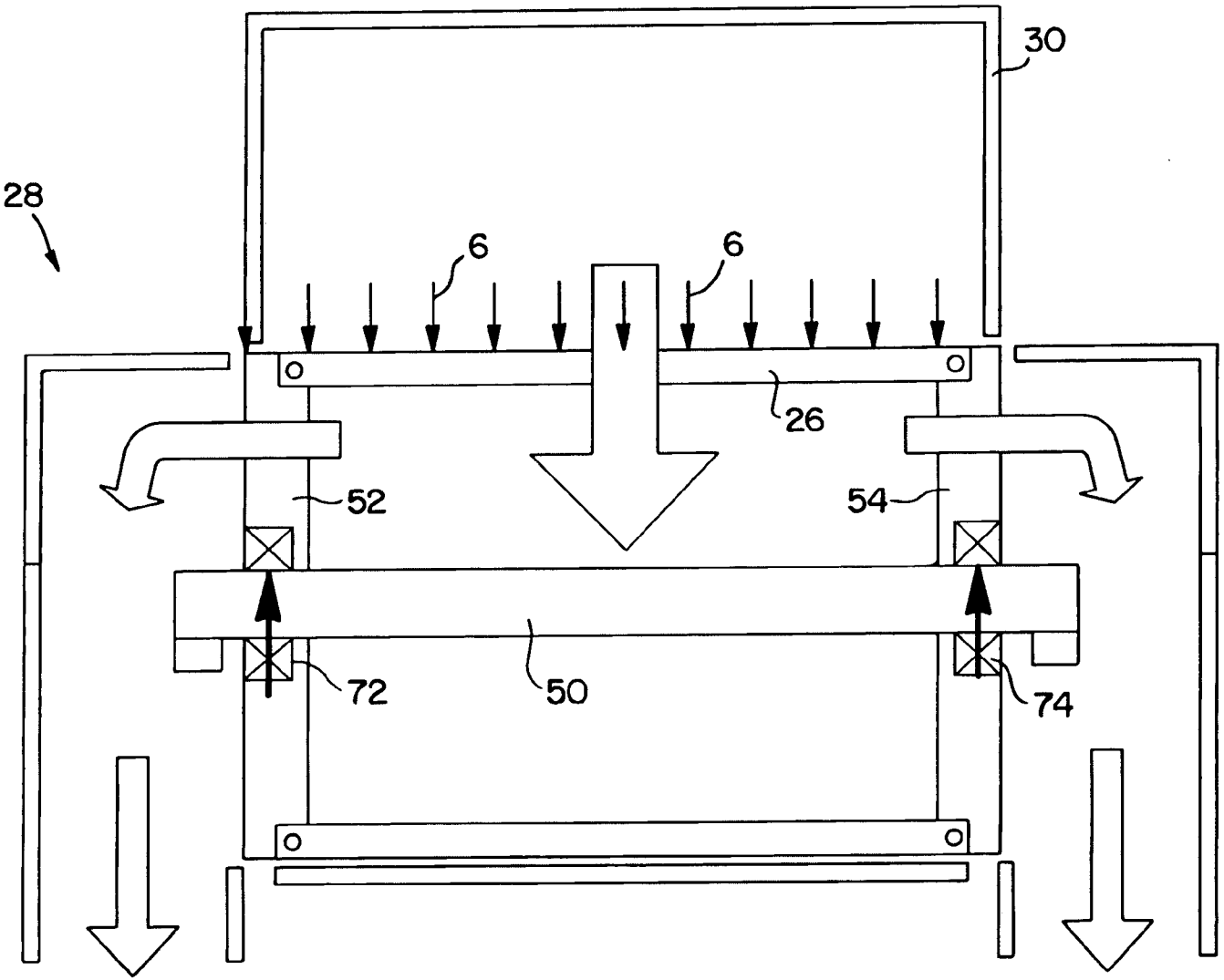
FIG. 6 is a diagrammatical view of a through-air dryer in accordance with the present invention.

As described above, the cylindrical deck 26 and all of the components that support the deck rotate about the stationary axis 50. In order to permit rotation of the deck, each of the hubs 52 and 54 are in association with a respective bearing 72 and 74. Of particular advantage, the bearings are positioned so as to be in substantial alignment with each end of the cylindrical deck 26. In this manner, no significant moment transfers occur between the deck and the support structure as diagrammatically shown, for instance, in FIG. 6. As illustrated in FIG. 6, the through-air dryer 28 is shown supporting a load 6 without the creation of the moments shown in FIG. 1.

In past through-air dryer configurations, as shown in FIG. 1, bearings were placed outside of the cylindrical deck in order to prevent the bearings from being contacted with the hot gas flow circulating through the dryer. In the through-air dryer illustrated in FIG. 3, however, the bearings 72 and 74 are shielded from air flow by the rotating tube 58 which is connected on one end to the hub 52 and on the opposite end to the hub 54. Thus, the bearings 72 and 74 are protected from high levels of heat transfer from the hot, humid air inside the through-air dryer.

As described above, gas flow direction through the through-air dryer 28 may be either from the hood 30 through the cylindrical deck 26 or through the cylindrical deck 26 and into the hood 30. When gas flow enters the through-air dryer through the cylindrical deck 26, the web being dried may be placed on top of the throughdrying fabric 24 as shown in FIG. 4. In this embodiment, gas flows through the web 16, through the throughdrying fabric 24 and between the deck plates 70. From the deck plates 70, the gas contacts the internal deck supports 60 and 62 as shown in FIG. 3. The internal deck supports 60 and 62 redirect the gas out through the hubs 52 and 54. Not shown, the hubs 52 and 54 may be placed in communication with a conduit for receiving the gas exiting the dryer. Once exiting the hubs 52 and 54, the gas may be collected and recycled as desired.

As shown in FIG. 2, the throughdrying fabric 24 is wrapped partially around the cylindrical deck 26 of the through-air dryer 28 leaving an open end towards the bottom of the deck. In the past, due to the construction of the through-air dryers, internal baffles were typically placed inside the cylindrical deck to prevent ambient air from entering the dryer.

One further advantage to the through-air dryer of the present invention is that the configuration of the through-air dryer does not require that the baffles be placed inside the cylindrical deck 26. Instead, as shown in FIG. 2, an external baffle generally 80 may be placed adjacent to the cylindrical deck over the open free end. As shown in FIG. 2, the external baffle 80 extends from one side of the throughdrying fabric 24 to an opposite side of the throughdrying fabric in order to prevent ambient air from entering the through-air dryer.

Another advantage to the through-air dryer of the present invention is that the dryer includes many multi-piece components. For example, the cylindrical deck is made from a plurality of deck plates 70. Also, most of the internal support members may be made from multiple parts.

Due to the construction of the through-air dryer 28, the through-air dryer may be manufactured and shipped having a shipping volume that is much less than the assembled volume of the dryer. For instance, in one embodiment, the largest dimension of the shipping volume is no greater than one half the diameter of the cylindrical deck. In this manner, expenses involved in shipping the through-air dryer are drastically reduced in comparison to many conventional dryers. In many locations in the world it is not physically possible or very difficult to ship a fully assembled dryer because of the limits of height, width and weight imposed for normal roadways or railroads.

Still another advantage to the through-air dryer of the present invention is the ability to easily calculate loads that are placed on the dryer during operation. The loads are easily calculated since there is no transfer of moment between the deck and support structure of the through-air dryer and since the deck is made of simple plates rather than a complicated welded structure. Typical decks are welded from a multitude of formed sheet metal components that are too complex to analyze using traditional analytical methods. Finite element analysis (FEA) can be used, but the complexity of the deck is generally beyond computing power except for small sections. To calculate the loads on a welded dryer deck, the properties of a small section are calculated in detail and the results are used as an average to compute the stresses on the entire deck. The stresses on the deck and the stresses caused by thermal expansion must then be used to compute the moment created across the interface between the deck and support structure. A complete explanation of calculating loads for one embodiment of a through-air dryer made in accordance with the present invention is included in the examples below.

EXAMPLE 1

One feature of the through-air dryer ("TAD") design of the present invention is the ability to rapidly calculate loads and deflections analytically using well-established mechanical engineering principles. The purpose of this example is to show analytical methods that may be used to calculate the deflections and loads on support bars for a TAD manufactured using the principles of this invention.

The TAD dryer deck is formed from a multiplicity of individual plates defining a cylinder. Each deck plate comprises a simply supported section bar as shown in FIG. 7.

The bar has an axial length (l), a radial width (w) and a thickness (t). For the purposes of this example the thickness and width is fixed as constant. Designs can be adjusted to vary both thickness and width to optimize the use of materials and enhance the process. For example the width can be varied to be larger at the locations of highest stress, generally in the center of an unsupported span. Likewise the thickness can be varied to be thin at the interface with the fabric to minimize wet spots, but be thick away from the fabric to add rigidity.

Figure 7:
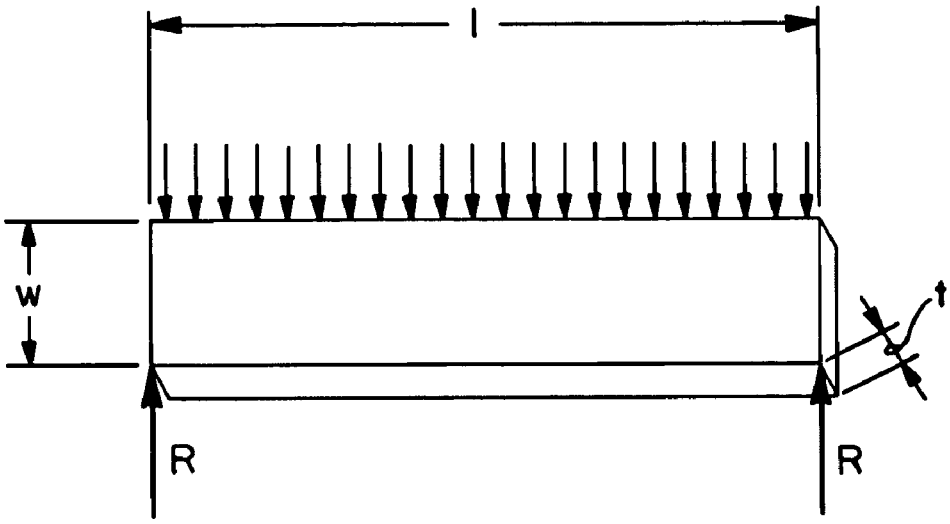
FIGS. 7–10 are demonstrative figures used for calculating loads on through-air dryers made in accordance with the present invention as is explained in the examples.

As shown in FIG. 7, there is a distributed unit load on the bar composed of the weight of the bar itself, fabric tension, pressure differential and centripetal acceleration of the bar on the rotating surface of the TAD deck. Each one of these loads will be calculated separately and summed to determine the total distributed load on the bar. Note that the load is not the same depending on the location of the bar. For example, areas of the dryer that are wrapped with the fabric subject the bar to the resultant of fabric load while areas of no fabric wrap have no load associated with the fabric.

Weight

The weight of the bar per unit length is calculated from the volume multiplied by the density of the material for one unit length. This can be calculated as:

$$\omega = w \cdot t \cdot l \cdot \delta \qquad \text{Eq. 1}$$

where: ω=weight per unit length
w=width
t=thickness
l=unit length
δ=density of material

Fabric Tension

The calculation of fabric tension requires additional information about the relative geometry between bar elements. The fabric tension is the resultant force of tension pulling on the bar because of the change of direction of the fabric across the bar.

Figure 8:
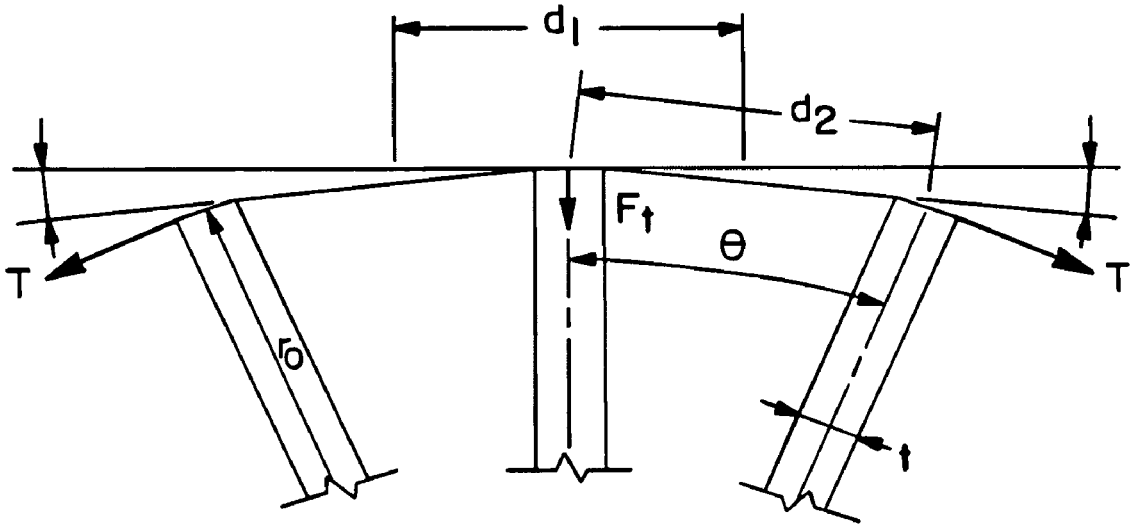

FIG. 8 shows a schematic of fabric tension acting on headbox bars. Fabric tension (T) creates a force on the bar by the change in angle of the fabric over the bar. The angle (θ) is determined by the 360° divided by the number of bars. A further example of a specific case will show the effect of changing the number bars versus the size of each bar to reduce the amount of deflection of the bar in service. A free body diagram of the bar shows that the resultant force on the bar ($F_t$) is as follows:

$$F_t = 2 \cdot T \cdot \sin\left(\frac{\theta}{2}\right) \qquad \text{Eq. 2}$$

Where: $F_t$ = Force per unit length from tension
$T$ = Fabric tension per unit length
$\theta$ = Change in angle between bars

Pressure

Gas or air flow is a process parameter that helps to determine the drying capacity of the TAD. Air flow creates differential pressure across the deck of the TAD and creates a load on the bars which comprise the deck. Referring further to FIG. 8 the distance ($d_1$) and the length (l) of the bar defines the chordal area where the pressure is applied that needs to be supported by each bar. Even though the pressure is applied to an angled surface, the principle of projected area allows the use of the chordal distance as the pressure area.

It can be seen by rotational symmetry that the distance ($d_1$) is equivalent to distance ($d_2$) which is the chordal distance between adjacent bars. Using this definition and using (d) as the distance between the bars the distance (d) can be calculated as:

$$d_1 = d_2 = d = 2 \cdot r_0 \cdot \sin\left(\frac{\theta}{2}\right) \qquad \text{Eq. 3}$$

Where: $d$ = Chordal distance between bars
$r_o$ = Outside radius of $TAD$
$\theta$ = Change in angle between bars The pressure is applied over an area defined by the length (l) and the distance (d). The force ($F_p$) generated for each bar can then be defined as:

$$F_p = \Delta P \cdot d \cdot l \qquad \text{Eq. 4}$$

Where: $F_p$=Force from differential pressure
d=Distance as defined in FIG. 8
l=Unit length of bar Substituting the value for distance (d) yields the following equation for the force created by differential pressure:

$$F_p = 2 \cdot \Delta P \cdot r_0 \cdot l \cdot \sin\left(\frac{\theta}{2}\right) \qquad \text{Eq. 5}$$

Where the variables are defined above.

Rotational Force

The rotation of the TAD causes forces to be applied to the bar. Specifically the bar tends to be thrown outward because of its location on the periphery of the TAD. The centripetal acceleration of the bar can be calculated using well-known mechanical principles. The force on the bar is a product of its mass and the acceleration of the bar caused by the constant change of direction of the bar. Centripetal acceleration is defined as the acceleration towards the center of the roll or in the normal direction relative to travel.

As a general case, it is possible to estimate the force created by a bar by using the centroid of the bar as the radius and the tangential velocity of the centroid as the velocity. This is the average centripetal acceleration of the bar. Since this design can be applied to small rolls, such as transfer rolls, as well as TADs and since the width of the bar can be a significant portion of the outside radius of the roll, a better method is to develop a general formula what includes the width of the bar. It can be seen that portions of the bar closer to the center of the roll have a lower velocity and a smaller radius. Since the velocity is squared, portions of the bar closer to the center of the roll contribute less to the force than portions nearer the periphery.

The normal acceleration is:

$$a_n = \frac{v^2}{r} \qquad \text{Eq. 6}$$

Where: $a_n$ = Centripetal acceleration $v$ = Tangential velocity $r$ = Radius of curvature Therefore the force on the bar from rotation of the dryer can be calculated based on Newton's third law as:

$$F_n = m \cdot a_n \qquad \text{Eq. 7}$$

Where: $F_n$=Normal force on bar from rotation
m=Unit mass of bar
$a_n$=Centripetal acceleration or with substitution is:

$$F_n = m \cdot \frac{v^2}{r} \qquad \text{Eq. 8}$$

Where variables are defined above.

Figure 9:
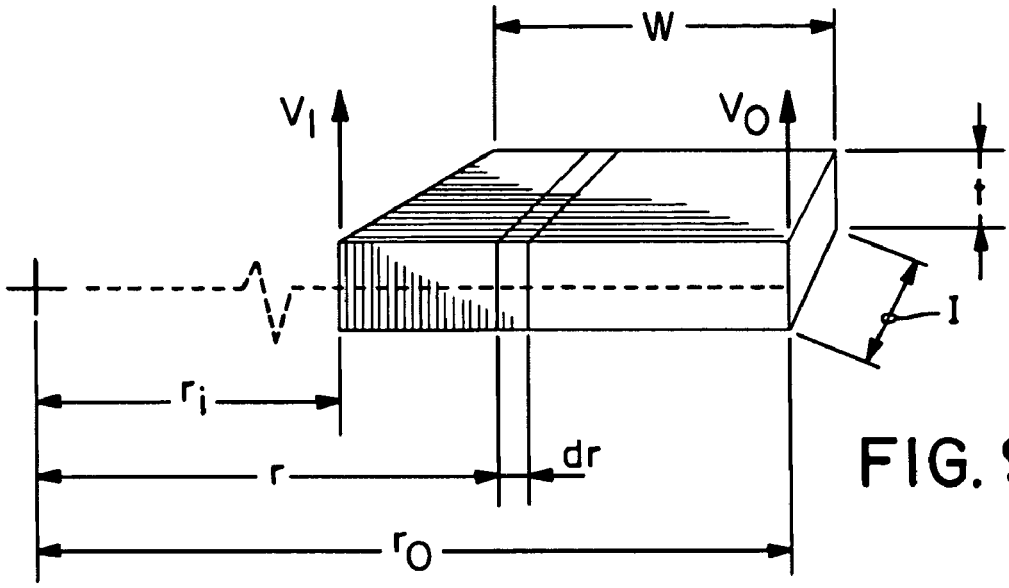

Using the centroid of the bar as shown in FIG. 9 an estimate for the force caused by rotation can be determined by substituting the radius of the centroid and the velocity of the centroid for v and r in the equation above.

$$r_c = \frac{r_o + r_i}{2} \text{ and } v_c = v_o\left(\frac{r_o + r_i}{2 \cdot r_o}\right)$$

Where: $r_c$ = radius of centroid of support plate $v_c$ = tangential velocity of centroid Then an estimate for the normal force on the bar from rotation can be determined as follows:

$$F_n = m \cdot \frac{v_o^2(r_o + r_i)}{2 \cdot r_o^2} \qquad \text{Eq. 9}$$

Where the variables are defined above.

Or substituting for m the equation becomes:

$$F_n = w \cdot l \cdot t \cdot \delta \cdot \frac{v_o^2(r_o + r_i)}{2 \cdot r_o^2} \qquad \text{Eq. 10}$$

Where the variables are defined above.

A more accurate value of the force ($F_n$) can be calculated by integrating the unit force along the length of the bar along the width from the inside of the bar to the periphery. In FIG. 9 a bar is shown relative to the center of the TAD. The inner radius ($r_i$) corresponds to the swept surface on the interior of the bars and outer radius ($r_o$) corresponds to the outside surface of the TAD swept by the support bars. Length (l) of the bar is the axial dimension across the surface of the TAD and thickness (t) in the circumferential direction. Note that the width (w) of the bar is determined by the difference between the inner and outer radii.

Velocity of the TAD is usually expressed in the velocity of the surface which is designated as the outer velocity ($V_o$) in FIG. 9. Based on the dimensions of the bar and the distance from the center of the TAD another velocity of the inner surface can be defined as the inner velocity ($V_i$) a value that is always less than the outer velocity and proportional to the outer velocity in the ratio of the inner to outer radii. A reference radius (r) is also defined which is a point between the inner and outer radius along the width of the support bar. An infinitesimal section of the bar at radius (r) is defined as "dr." With these definitions it is possible to see that the force of section "dr" is defined as:

$$dF_n = dm \cdot a_n \qquad \text{Eq. 11}$$

Where: $dF_n$=Normal force on bar section from rotation
dm=Unit mass of bar
$a_n$=Centripetal acceleration Also note that a section of bar is composed of an element of mass as follows:

$$dm = l \cdot t \cdot \delta \cdot dr \qquad \text{Eq. 12}$$

Where: dm=Unit mass of bar
t=thickness
l=unit length
δ=density of material
dr=section of support bar Also note that the velocity of the bar at distance "r" from the center of the TAD roll is defined as:

$$V(r) = V_i \frac{r}{r_i} \qquad \text{Eq. 13}$$

Where: $V(r)$ = Velocity at distance "$r$"

$V_i$ = Velocity at "$r_i$"

$r_i$ = radius on inside of support bar $r$ = distance from center of *TAD*

Using this value it can be seen that the centripetal acceleration is now:

$$a_n = \left(V_i \frac{r}{r_i}\right)^2 \left(\frac{1}{r}\right) = \frac{V_i^2}{r_i^2} r \qquad \text{Eq. 14}$$

Where the variables are defined above.

The centripetal acceleration is seen to vary directly with the radius at constant surface speed. Therefore substituting the centripetal acceleration and dm into the equation for $dF_n$, and integrating from $r_i$ to $r_o$ gives the following result for $F_n$.

$$dF_n = l \cdot t \cdot \delta \cdot \frac{V_i^2}{r_i^2} r \cdot dr \qquad \text{Eq. 15}$$

$$\text{therefore: } F_n = l \cdot t \cdot \delta \cdot \frac{V_i^2}{r_i^2} \int_{r_i}^{r_o} r \cdot dr$$

Integrating and substituting the values $r_i$ and $r_o$ yields the following equation for $F_n$. Note that the constant is zero because the $F_n$ at zero is zero.

$$F_n = l \cdot t \cdot \delta \cdot \frac{V_i^2}{2 \cdot r_i^2} (r_o^2 - r_i^2) \qquad \text{Eq. 16}$$

Where the variables are defined above.

This equation is the more general form used to calculate the force created on the support bars from TAD rotation.

Deflection

The amount of deflection of the bar under load is a consideration for tissue machine design since deflection can have an adverse effect on the ability of the fabric to guide or can cause the fabric to develop wrinkles which make it unusable. The total load on each support bar is the sum of the weight of the bar, force from fabric tension, force from differential pressure and rotational forces. The combination of these forces causes deflection of the bar with the maximum deflection typically near the center of the unsupported span. Note that the load is not constant around the circumference of the TAD since the fabric does not wrap the entire TAD surface. That is, fabric tension forces and differential pressure forces only exist in areas that are wrapped by the TAD fabric. Also, the direction of the force changes with the position of the bar during the rotation of the TAD. For example, the weight of the bar is always directed downwards, rotational forces are directed radially outwards, and fabric tension and differential pressure forces are directed radially inwards towards the center of the TAD. The changes in direction of forces are shown schematically in FIG. 10.

Figure 10:
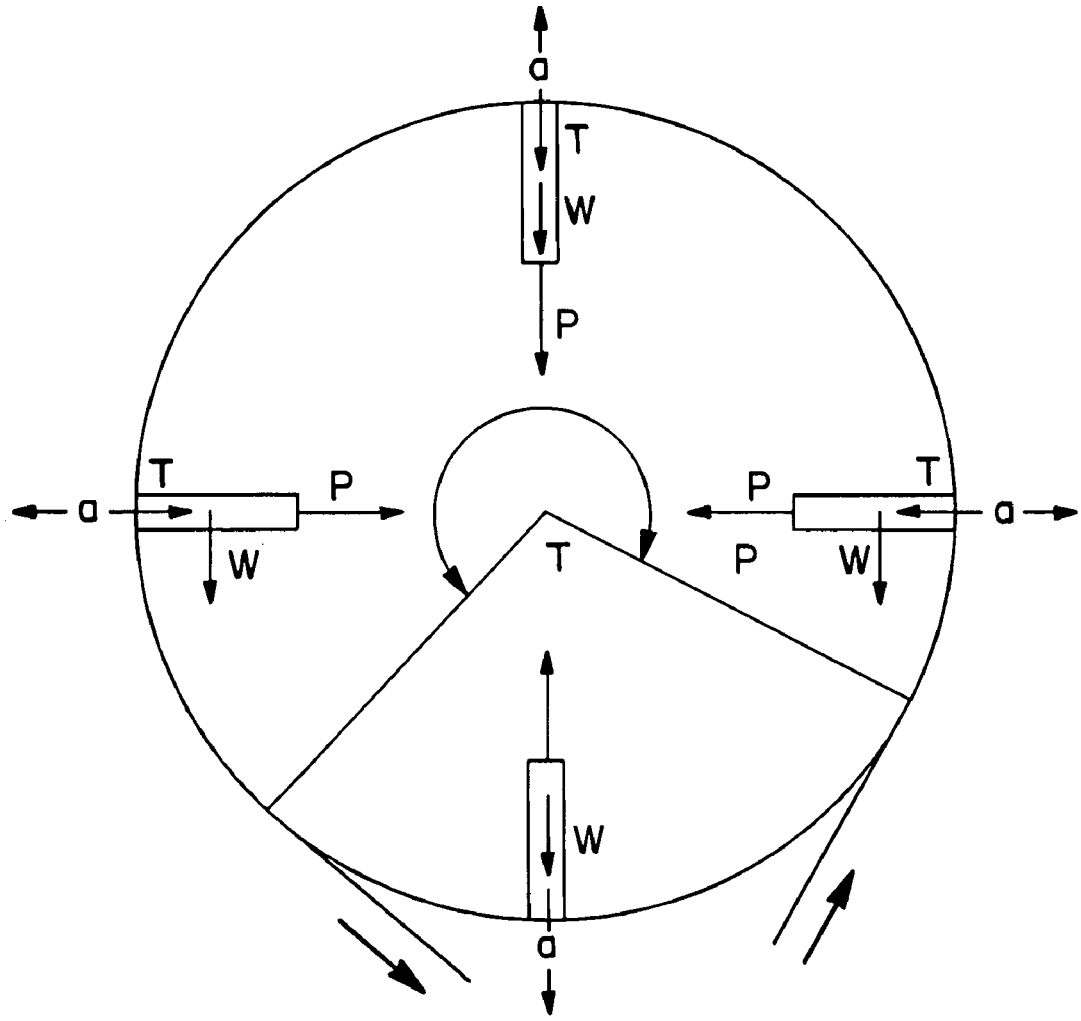

Referring to FIG. 10, "T" represent the fabric tension, "P" force from differential pressure, "w" force from weight, and "a" force from centripetal acceleration. At the 12 o'clock position on the TAD it can be seen that the centripetal acceleration tends to reduce the overall force while at the 6 o'clock position it add to the force from the weight of the bar.

It is necessary to calculate the load at key positions on the TAD deck to ensure that all potential cases are accounted for. It is also possible to calculate the fluctuation in load at a given speed which is important for the design of the end connections and to analyze potential reduction in life from fatigue loading.

Deflection is a function of the type of loading, type of end connections, load applied and the properties and geometry of the material used. For the case of the support bars, by definition of the invention, no moment is transferred between the support bars and the head so the bars are simply supported. This means that there is a single reaction force at each end of the bar designated as "R" in FIG. 7. All loads on the bar are distributed loads, that is, they do not act at a point, but have a uniform nature over a defined distance. All loads for the case of the support bar act over the entire length of the bar. Using accepted principles in mechanics it is possible to sum the loads to determine a combined final distributed load on the bar.

For small amounts of deflection, as present in the TAD support bars, it is acceptable to use standard beam deflection equations. The specific equation for a simply support beam with a distributed load is as follows:

$$f = \frac{W}{EI} \frac{5 \cdot l^3}{384} \qquad \text{Eq. 17}$$

Where: $f$ = deflection $W$ = Total load, that is $w \times l$ $E$ = Young's Modulus of material $I$ = Rectangular moment of inertia $l$ = length of bar Note that for a simply supported beam the deflection is five times as high as the deflection of a fully supported beam. The equation for deflection can be rearranged noting that W=wl as follows. Note that for an equivalent unit load the deflection varies with the fourth power of length showing that the addition of internal supports to the bar is very beneficial to reducing deflection.

$$f = \frac{w}{EI} \frac{5 \cdot l^4}{384} \text{ Where: } w = \text{unit load} \qquad \text{Eq. 18}$$

Other variables defined above.

It can be seen that standard mechanical engineering techniques permit an analytical solution to the calculation of loads and deflection of the support bars for a TAD deck. The key is to have the bars simply supported so the moment is not transmitted to the heads of the TAD.

EXAMPLE 2

The following is a prophetic example using the equations derived in Example 1. Typical dimensions of a through-air dryer ("TAD") were used. A typical TAD for the manufacture of tissue paper products is about 5 m (16.4 feet) in diameter, has a width of 5.2 m (17.1 feet). A typical maximum operating speed is 1500 m/min (4921 ft/min) at the surface of the deck. Maximum deflection of 3 millimeters (⅛ inch) is allowed although less is preferable to prevent premature wear or wrinkling of the fabric. For the case of this example, the bars are rectangular in shape although there are advantages to reducing the thickness of the bar at the periphery of the TAD where the bars contact the fabric to prevent non-uniform air flow as previously discussed.

Also, a rectangular bar is not the optimum shape for maximizing the rectangular moment of inertia relative to the weight. A manufactured material consisting of a tube with wearing surfaces would provide more rigidity especially to prevent buckling failure in unsupported areas. These types of shapes are readily available and can be readily calculated using the principles discussed in this example.

The spacing of the bars needs to adequately support the fabric and spread the load from differential pressure and fabric tension. A reasonable spacing is 75 millimeters (2.95 inches), but larger spacing can be accommodated if an intermediate support structure is inserted between the support bars to support the fabric and prevent oscillations in fabric tension from the chordal distances between the support bars. Note that the main support remains the axially oriented bars. The selection of the number of bars is generally the maximum possible to minimize overall weight, commensurate shipping costs and handling, and to reduce assembly time at the site of use. Based on a spacing of 75 millimeters and a dryer diameter of 5 meters with a circumference of 15,707 millimeters, the number of bars will be 210, rounded to the nearest whole number. Based on the number of bars, it is possible to calculate that the change in angle between each bar will be 1.71 degrees. This angle is used to determine the forces from tension and differential pressure.

The support bar dimensions ultimately determine the amount of deflection and contribute to the overall weight of the TAD. Another factor determined by bar dimensions is the number of internal supports that will be required to minimize deflection. Deflection varies with the fourth power of length so a support in the center of the dryer will reduce deflection by a factor of sixteen. Additional supports will be required to prevent buckling failure from twisting, or movement in the circumferential direction as a simple bar has little stiffness in this direction. It was determined that a suitable bar dimension for this example is a bar with dimensions of 180 millimeters (7.4 inches) in the radial dimension (width) and 7 millimeters (0.28 inches) in thickness for a bar that is solid and rectangular in cross section.

The thickness of the bar and the number of bars determine the amount of open area of the dryer which is calculated as a percentage of the rotated surface of the dryer that is not blocked by bars relative to the entire surface. For this example the open area is calculated to be 91% which is calculated as the ratio of the area of the outside surface of the through-air dryer less the area of the thickness of the bar to the surface of the through-air dryer. Note that it is advantageous to taper the tip of the support bar to retain the stiffness while increasing the open area of the dryer. It is expected that a final bar design will be optimized to increase open area, minimize stiffness and maximize stiffness in the radial and circumferential directions. A structure such as a hollow could be used to reduce weight while increasing stiffness.

The dimensions of the bar give the weight per unit load based on Equation 1. The material of construction is mild steel. The density of steel is 7756 kg/m$^2$ (0.28 lb/in$^2$) so the load contributed by the bar can be calculated to be 0.10 kN/m (0.57 lb/in). Note that the load contributed by weight is always directed downwards and is present in all locations.

Fabric tension is typically in the range of 1.75 to 10.5 kN/m (10 to 60 lb/in) for all fabrics. TAD fabrics are generally run at a maximum of about 4.4 kN/m (25 lb/in). Therefore this example uses 4.4 kN/m (25 lb/in) as the fabric tension.

The force of the fabric is the resultant force on the bar from fabric tension as determined by Equation 5. The angle is the change in angle between adjacent bars as shown in FIG. 8. For this example the angle θ is 1.71 degrees so the resultant force from tension is therefore 0.13 kN/m (0.74 lb/in). It can be seen that closer spacing from having more support bars in the design will reduce this value. Note that fabric tension only creates a force when the fabric is present, which for this example is about 260 degrees of wrap. When fabric tension is present it always creates a force that is directed radially towards the centerline of the TAD cylinder.

Rotational forces are created by a combination of the mass of the bar and the continual acceleration of the bar towards the center of the TAD to maintain its circular path. In general, it is preferable to use Equation 15 to calculate the force from rotational load, although for examples where the radial dimension of the bar is much smaller than the radius of the dryer the results using Equation 10. Based on a speed of 1500 meters/minute (4921 feet/minute) or 25 meters/second, an outer radius of 2.5 meters and a bar dimension of 170 millimeters by 7 millimeters, the force from rotation is 2.36 kN/m. Rotational force is always directed away from the center of the TAD and is always present when the dryer is rotating. The force from rotation is proportional to the square of speed so that load increases parabolically with speed. For this example the load from rotational forces has the highest magnitude of the four forces considered.

Each of the four forces, which are load from weight, fabric tension, differential pressure and rotation create a uniform distributed load on the bar. A feature of beam loading of any type is that it is possible to sum the effect of each component of load to determine the overall load, commonly referred to as the principle of superposition. For the case of the support bar the overall load is a sum of each of the four loads previously mentioned based on the current location of the bar relative to gravity and the fabric loading. As previously mentioned, fabric tension and differential pressure are only present in parts of the circumference of the dryer that are in contact with the fabric. Note that differential pressure is not required to be present for the entire contact surface of the fabric, but this is beneficial and common to maximize the drying capability of the TAD.

Since deflection of the bar relative to the center of the TAD is important for structural reasons, load will be considered in the positive direction away from the center of the TAD and negative towards the center of the TAD. This leads to positive and negative deflection in the same sense as the load. The sum of the loads in the instantaneous position of the bar relative to gravity and the presence or absence of the fabric determine the final load. To help to illustrate this a table of loads has been developed below. It can be seen that the significant load on the dryer is actually away from the center of the dryer at an operating speed of 1500 meters per minute and that the maximum load occurs at the 6 o'clock position where there is no counteracting force from fabric tension and differential pressure but weight and rotational forces are additive.

| Load Source | Radial Force (kN) at Different Positions | | | |
|---|---|---|---|---|
| | 12 o'clock | 3 o'clock | 6 o'clock | 9 o'clock |
| Weight | 0.10 | 0.00* | −0.10 | 0.00* |
| Fabric Tension | 0.13 | 0.13 | 0.00 | 0.13 |
| Differential Pressure | 0.56 | 0.56 | 0.00 | 0.56 |
| Rotation | −2.36 | −2.36 | −2.36 | −2.36 |
| Total | −1.57 | −1.67 | −2.46 | −1.67 |

*force from weight not radial in direction.

Also to note is that the weight does not contribute to radial forces in the 3 o'clock and 9 o'clock positions since weight always creates a downward force.

Deflection of the bar is calculated using Equation 18. These equations are developed from four successive integrations of the load on a beam and are accurate for small deflections relative to the length of the beam. Equation 18 is for a simply supported beam which means that the beam is supported at each extremity, but no moment is transferred from the beam to the supports. The deflection of the bar calculates to be 0.837 inches at the 12 o'clock position and 1.307 inches at the 6 o'clock position.

Using a center support changes the load case from a simply supported beam to a beam that is simply supported on one end and cantilevered on the other. A free body diagram of half the bar shows the moment which is symmetrical for each side. Note that the moments now present at the center support are internal to the bar and are not transferred to other TAD components.

The equation for deflection of a beam with a distributed load, simply supported on one end and cantilevered on the other end is as shown in Equation 19 below. There is a reduction of one sixteenth because of the fourth power change from reducing the span by half and an additional 2.4 times reduction from cantilevering the beam at one end for a total reduction in deflection of 38.5 times by installing a support in the center span. The deflection is now reduced to 0.022 inches at the 12 o'clock position and 0.034 inches at the 6 o'clock position.

$$f = \frac{w}{EI}\frac{l^4}{185} \quad \text{Where}: w = \text{unit load} \qquad \text{Eq. 19}$$

Other variables defined above.

The maximum stress in the beam occurs in the extreme edges of the widths commonly referred to as the "outer fibers" when discussing stress in beam theory. The maximum stress occurs at a location of maximum moment in the beam, such as at mid-span for a simply supported beam, and at the outermost fiber of the beam. It can be calculated by using the following Equation 20 below:

$$\sigma_{max} = \frac{Mc}{I} \quad \text{Where} \qquad \text{Eq. 20}$$

$M$ = the maximum moment $c$ = distance from the neutral axis $I$ = rectangular moment of inertia The distance "c" is the maximum distance from the neutral axis of the cross section of the beam. A simple bar has the neutral axis at the center line of the beam or at 85 millimeters from the edge. Therefore "c" is the same distance of 85 millimeters from the neutral axis to the outer fiber. The maximum moment is calculated from the beam equations as:

$$M_{max} = \frac{wl^2}{8} \text{ at } \frac{3l}{8}$$

for simply support beam, distributed load $$M_{max} = \frac{9}{128}wl^2 \text{ at } \frac{3l}{8}$$

from the simply supported end for a simply/cantilevered beam

The maximum moment for the simply supported case with full span can be calculated as 8.28 kNm and as 1.17 kNm for the case with a center support. Note the center support reduces the length "l" in half and also the different load case provides a further reduction in moment. Therefore using Equation 20 it can be seen that the maximum level of stress is 31,412 lb/in$^2$ for the simply supported case and 4,417 lb/in$^2$ for the case with a support. The range of load at operating speed is seen to be varying, but always in the same sense, that is, there is no reversal of stress which greatly reduces the impact of fatigue loading on the bars.

The load on the bar that is not directed radially is also important to note. This occurs with the force from the weight of the bar in the 3 o'clock and 9 o'clock positions. While the load is small, the area moment of inertia of the bar is 660 times lower that the area moment of inertia in the radial direction. Supporting the bars between each other for this design in three locations evenly spaced across the length of the bar will reduce the deflection. Supports do not have to be connected to the center axis of the TAD, but may be between the individual bars themselves.

It is also advantageous to provide additional calculations to test that vibration will not be a concern and to test any stress concentrations that arise from machining of the bar from its standard rectangular profile. This would include, but is not limited to, holes required for mounting the center support and stiffening components and the connection of the bar to the deck.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. An apparatus for through-air drying webs cormprising:

a rotatable cylindrical deck having sufficient open space to permit air flow therethrough, the rotatable cylindrical deck comprising a plurality of individual deck plates;

a support structure positioned to support the rotatable cylindrical deck, the support structure being attached to the individual deck plates;

a support shaft concentrically positioned with respect to the rotatable cylindrical deck, the support structure being mounted on the support shaft; and a hood surrounding the cylindrical deck for directing a hot gaseous stream through the cylindrical deck or away from the cylindrical deck.

2. An apparatus as defined in claim 1, wherein the individual deck plates are attached to the support structure using a pin attachment structure.

3. An apparatus as defined in claim 1, wherein the deck plates have a cross sectional profile that tapers in a direction opposite the direction of gas flow through the cylindrical deck.

4. An apparatus as defined in claim 1, wherein the support structure is configured to rotate on the support shaft and wherein the apparatus further comprises at least one bearing positioned between the support shaft and the support structure to permit rotation of the support structure, the bearing being located so that there is substantially no moment transfer between the cylindrical deck and the support structure.

5. An apparatus as defined in claim 1, further comprising a throughdrying fabric wrapped around the cylindrical deck, the throughdrying fabric being configured to carry a web over a portion of the surface of the deck.

6. An apparatus as defined in claim 5, wherein the throughdrying fabric is wrapped around the cylindrical deck from an upstream point to a downstream point leaving an open free end, and wherein the apparatus further comprises an external baffle positioned over the open free end of the cylindrical deck, the external baffle shielding the open free end of the drying cylinder from external air.

7. An apparatus as defined in claim 4, wherein the support structure comprises a first hub spaced from a second hub, each hub engaging an opposite end of the cylindrical deck, the apparatus including a first bearing and a second bearing, the first bearing being positioned between the first hub and the support shaft and the second bearing being positioned between the second hub and the support shaft, each bearing being substantially in alignment with each end of the cylindrical deck.

8. An apparatus as defined in claim 7, wherein the support structure further comprises:

a rotating tube surrounding the support shaft, the rotating tube being connected at a first end to the first hub and at a second end to the second hub;

at least one internal deck support extending between the rotating tube and the cylindrical deck; and a deck support ring supporting the cylindrical deck in between the first end of the cylindrical deck and the second end of the cylindrical deck, the support ring being connected to the at least one internal deck support.

9. An apparatus as defined in claim 8, wherein the support structure includes a first internal deck support and a second internal deck support extending between the rotating tube and the cylindrical deck, each of the deck supports being connected to the deck support ring.

10. An apparatus as defined in claim 1, wherein at least 80% of the surface of the cylindrical deck is open for allowing gas flow.

11. An apparatus as defined in claim 9, wherein the first deck support and the second deck support have a useful shape for directing gas flow between the cylindrical deck and the first and second hubs and wherein the rotating tube shields the first bearing and the second bearing from the gas flow.

12. An apparatus for through-air drying webs comprising:

a rotatable cylindrical deck having sufficient open space to permit air flow therethrough, the rotatable cylindrical deck comprising a plurality of individual deck plates;

a support structure positioned to support the rotatable cylindrical deck, the support structure being attached to the individual deck plates;

a support shaft concentrically positioned with respect to the rotatable cylindrical deck, the support structure being mounted on the support shaft; and a throughdrying fabric wrapped around the cylindrical deck, the throughdrying fabric being configured to carry a web over a portion of the surface of the deck.

* * * * *